US005690597A

United States Patent [19]

Enfaradi

[11] Patent Number: 5,690,597

[45] Date of Patent: Nov. 25, 1997

[54] MARTIAL ARTS EXERCISE APPARATUS

[76] Inventor: Abbas Enfaradi, P.O. Box 18927, Atlanta, Ga. 31126

[21] Appl. No.: 663,513

[22] Filed: Jun. 13, 1996

[51] Int. Cl.[6] ..... A63B 21/00

[52] U.S. Cl. ..... 482/126; 482/91; 482/907; 482/83

[58] Field of Search ..... 482/83, 44, 91, 482/907, 904, 135, 131, 79, 80

[56] References Cited

U.S. PATENT DOCUMENTS

| | | | |
|---|---|---|---|
| 4,149,713 | 4/1979 | McLeod | 482/101 |
| 5,125,880 | 6/1992 | Peters | 482/79 |
| 5,147,266 | 9/1992 | Ricard | 482/907 |
| 5,199,934 | 4/1993 | Lin | 482/79 |
| 5,230,676 | 7/1993 | Terauds | 482/79 |
| 5,295,935 | 3/1994 | Wang | 482/126 |
| 5,437,591 | 8/1995 | Chen | 482/126 |
| 5,558,607 | 9/1996 | Darling | 482/907 |

*Primary Examiner*—Jerome Donnelly

[57] ABSTRACT

An exercise apparatus includes a frame which includes a first pair of tracks and a second pair of tracks. A first handle is received in the first pair of tracks, and a second handle is received in the second pair of tracks. A motion-resistant assembly is connected between the first handle and the second handle. A base member is provided, and a frame-to-base pivot assembly, which lies in a vertical plane, is connected between the frame and the base member. When the frame and the base member move relative to each other around the pivot assembly, they move in a horizontal plane. The frame-connected bracket assembly can include a first bracket member connected to the frame, a second bracket member received by the first bracket member and adjustable longitudinally therewith, and a bracket lock connected between the first bracket member and the second bracket member. A kick target assembly can be connected to the frame. The frame-connected bracket assembly can include a vertical orientation adjustment assembly which pivots around horizontal pivots and moves in a vertical plane. A tank-containing base assembly can be provided which includes an annular tank and a reception well for receiving the first vertical adjuster member of the frame-connected bracket assembly. Water is added to the annular tank to provide a floor-supported base for the exercise apparatus.

14 Claims, 5 Drawing Sheets

FIG 1
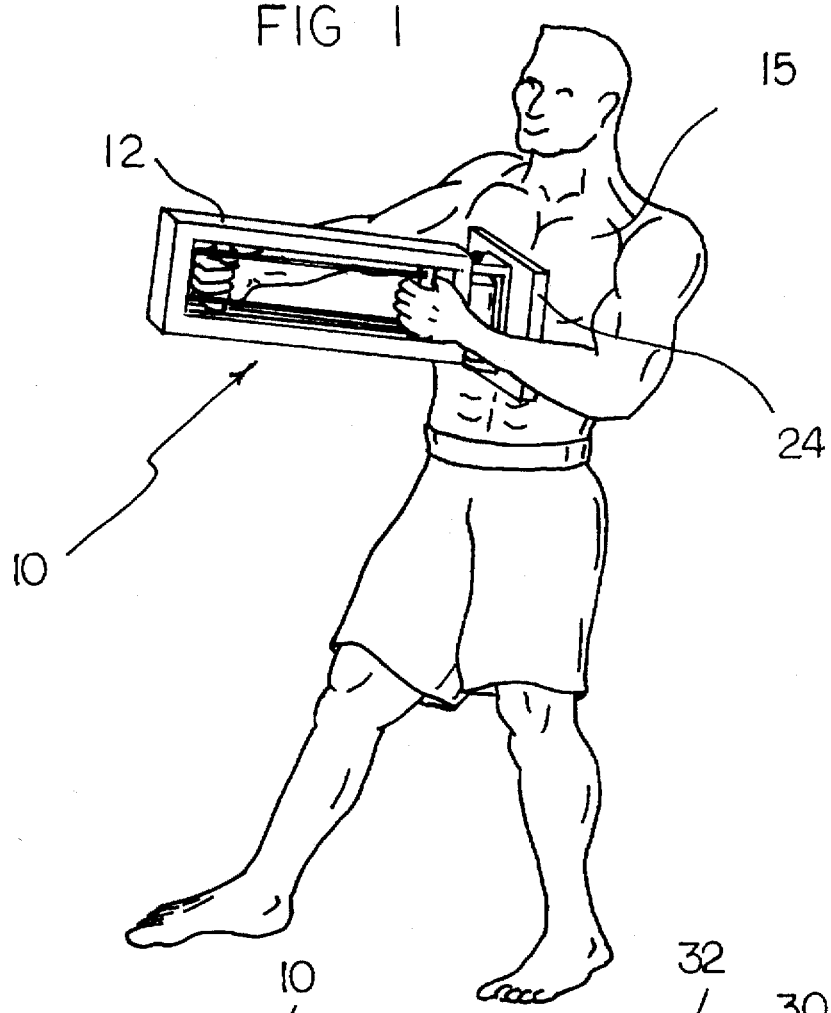
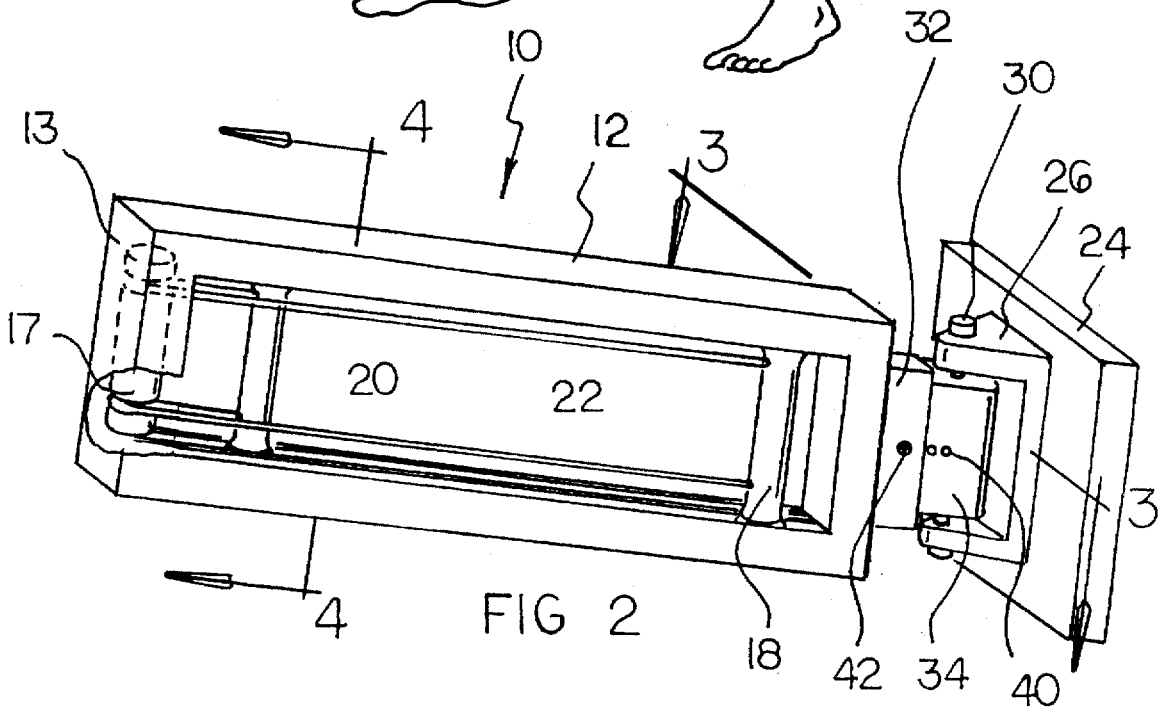
FIG 2

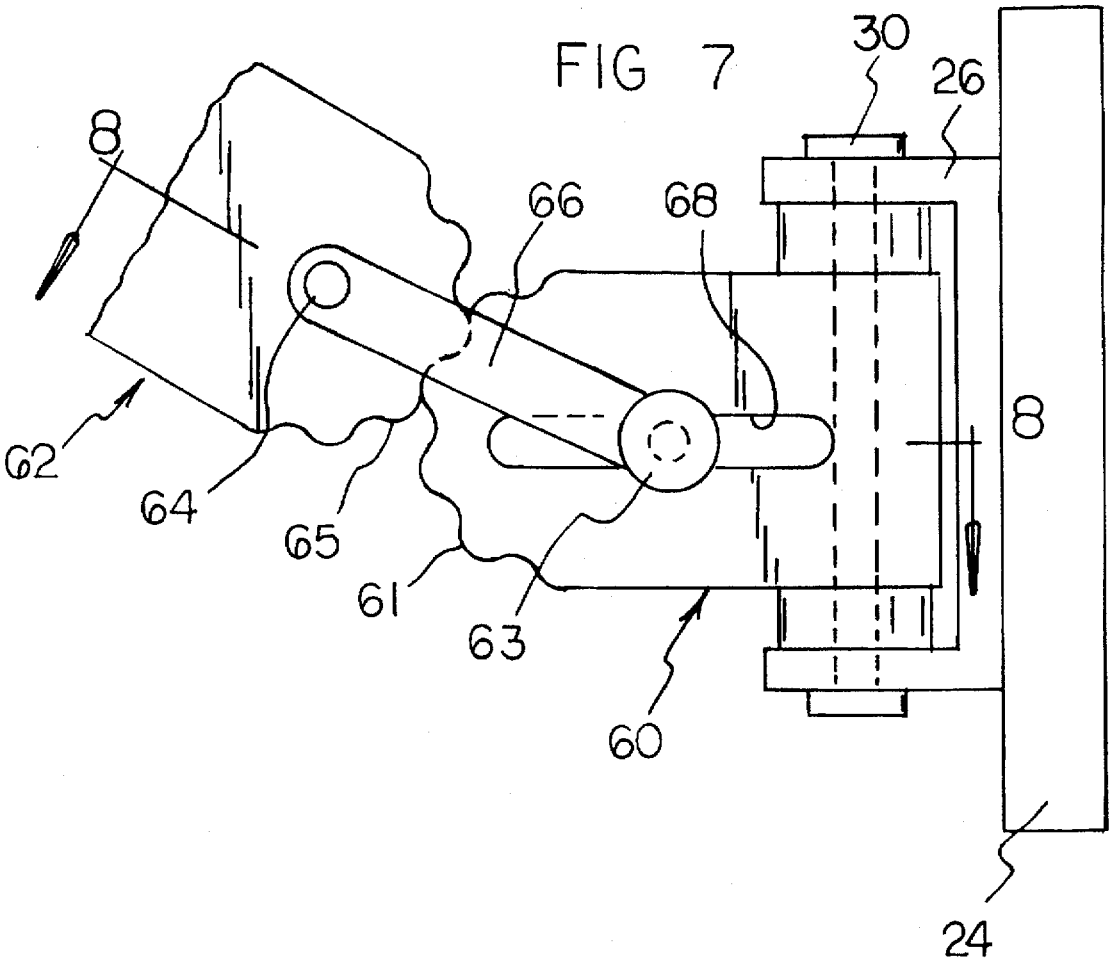
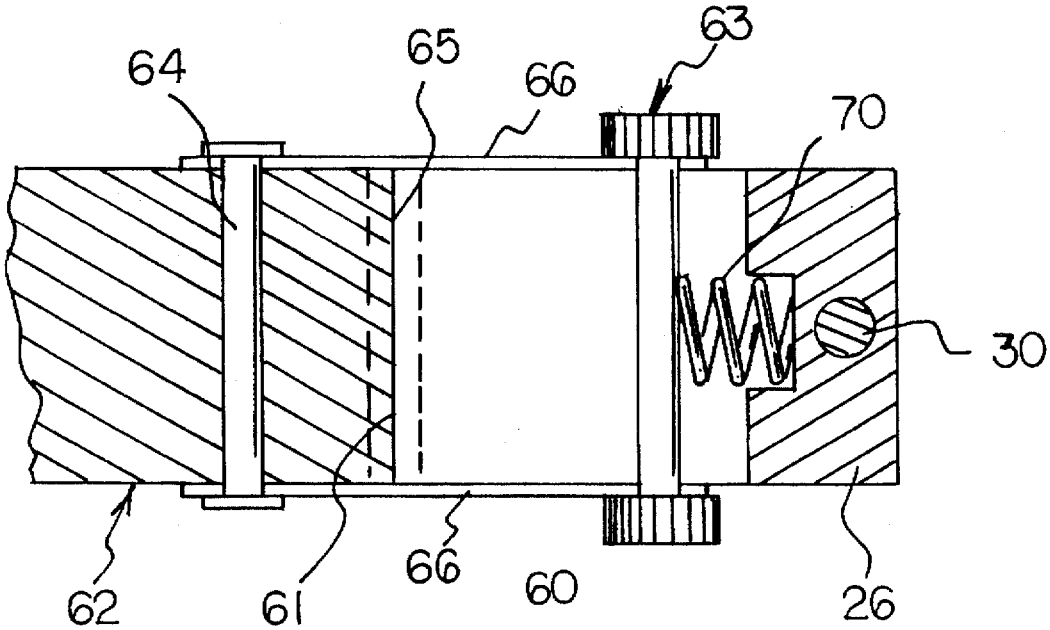
FIG 8

MARTIAL ARTS EXERCISE APPARATUS

BACKGROUND OF THE INVENTION

1. Field of the Invention

The present invention relates generally to exercise devices and, more particularly, to exercise devices especially adapted for practicing martial arts maneuvers.

2. Description of the Prior Art

In the martial arts there are numerous maneuvers which are carried out. Some of the maneuvers involves the hands and arms. Other maneuvers involve the legs and feet. Some maneuvers involve arms and hands followed rapidly by legs and feet. Whatever martial arts maneuvers are contemplated, it is a good idea for a martial arts practitioner to carry out exercises that help build strength and endurance for carrying out the maneuvers. In this respect, it would be desirable if an exercise device were provided which permits a person to build strength and endurance for carrying out martial arts maneuvers that involve arms and hands. Similarly, it would be desirable if an exercise device were provided which permits a person to build strength and endurance for carrying out martial arts maneuvers that involve legs and arms.

Still other features would be desirable in a martial arts exercise apparatus. For example, one type of martial arts maneuver involves a rapid extension of one arm accompanied by a rapid contraction of the other arm. This maneuver is followed by a rapid reversal of contraction and extension of the respective arms. In this respect, it would be desirable if an exercise device were provided which permits a person to build strength and endurance for carrying out martial arts maneuvers that involve a rapid extension of one arm accompanied by a rapid contraction of the other arm.

Another type of martial arts maneuver involves a kicking with a leg and foot. In this respect, it would be desirable if an exercise device were provided which permits a person to build strength and endurance for carrying out martial arts maneuvers that involves kicking with a leg and foot.

Different persons have arms and hands of different length. In this respect, it would be desirable if an exercise device were provided which permits a person to build strength and endurance for carrying out martial arts maneuvers and that is adjustable for different persons' arms and hands.

When a martial arts practitioner carries out the above-described arms and hands exercises, the angle between the person's chest and arms changes when alternating arm contraction and retraction take place. In this respect, it would be desirable if an exercise device were provided which permits a person to build strength and endurance for carrying out martial arts maneuvers and that involves automatically adjusting when the angle between the person's chest and arms changes when alternating arm contraction and retraction take place.

Some maneuvers that a martial arts person performs involve having arms and hands extend and retract in a plane that is substantially horizontal and parallel to a floor surface. However, there are other maneuvers performed by a martial arts practitioner in which a person's arms and hands extend and retract in a plane that forms an obtuse angle with respect to a horizontal surface. In this respect, it would be desirable if an exercise device were provided which permits a person to build strength and endurance for carrying out martial arts maneuvers that involve extending and retracting a person's arms and hands in a plane that forms an obtuse angle with respect to a horizontal surface.

When a martial arts practitioner wishes to perform exercises that involve kicking maneuvers, there may be times when the person wishes to practice kicking in a hands-free manner. In this respect, it would be desirable if an exercise device were provided which permits a person to build strength and endurance for carrying out martial arts maneuvers that involve kicking in a hands-free manner.

When a martial arts practitioner practices kicking maneuvers, there are times when the person may want to adjust the location of the kicking target. In this respect, it would be desirable if an exercise device were provided which permits a kicking target to be adjusted with respect to its height and its distance from the person exercising.

In view of the above, it would be desirable if a martial arts exercise apparatus would have the following combination of desirable features: (1) permits a person to build strength and endurance for carrying out martial arts maneuvers that involve arms and hands, that involve legs and arms, that involve a rapid extension of one arm accompanied by a rapid contraction of the other arm, and that involves kicking with a leg and foot; (2) is adjustable for different persons' arms and hands; (3) automatically adjusts when the angle between the person's chest and arms changes when alternating arm contraction and retraction take place; (4) can be used when a person extends and retracts one's arms and hands in a plane that forms an obtuse angle with respect to a horizontal surface; (5) permits a person to build strength and endurance for carrying out martial arts maneuvers that involve kicking in a hands-free manner; and (6) permits a kicking target to be adjusted with respect to its height and its distance from the person exercising. The foregoing desired characteristics are provided by the unique martial arts exercise apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides an exercise apparatus which includes a frame which includes a first pair of tracks and a second pair of tracks. A first handle is received in the first pair of tracks, a second handle is received in the second pair of tracks. A motion-resistant assembly is connected to the first handle and the second handle. A base member is provided, and a frame-to-base pivot assembly is connected between the frame and the base member.

The motion-resistant assembly includes a pulley positioned between the first pair of tracks and the second pair of tracks at a first end of the frame, and a pair of flexible lines extended around a portion of the pulley and connected between the first handle and the second handle.

The frame-to-base pivot assembly includes a base-connected bracket connected to the base member. A frame-connected bracket assembly is connected to the frame, and a pivot pin is connected between the base-connected bracket and the frame-connected bracket assembly. The pivot pin lies in a vertical plane. With the pivot pin in a vertical plane, when the frame and the base member move relative to each other, they move in a horizontal plane.

The frame-connected bracket assembly includes a first bracket member connected to the frame, a second bracket member received by the first bracket member, and a bracket lock connected between the first bracket member and the second bracket member. The first bracket member includes a first pin channel. The second bracket member includes a plurality of selectable second pin channels, and the bracket lock includes a locking pin that is placed through the first pin channel and one of the selected second pin channels when the first pin channel and the selected second pin channel are placed in registration.

A kick target assembly is connected to the frame. The kick target assembly includes a kick target member and a target adjustment assembly connected between the kick target member and the frame. The target adjustment assembly includes a first orientation-adjustment lock connected to the frame. A first extension assembly is connected to the first orientation-adjustment lock. A second orientation-adjustment lock is connected to the first extension assembly. A second extension assembly is connected to the second orientation-adjustment lock. A third orientation-adjustment lock is connected to the second extension assembly, and a third extension assembly is connected to the third orientation-adjustment lock. A kick-target-support bracket is connected to the third extension assembly. The kick target member is connected to the kick-target-support bracket.

The frame-connected bracket assembly includes a vertical orientation adjustment assembly. The vertical orientation adjustment assembly includes a first vertical adjuster member connected to the pivot pin, a second vertical adjuster member connected to the frame, and a binder assembly connected between the first vertical adjuster member and the second vertical adjuster member. The first vertical adjuster member includes an outer first geared surface, and the second vertical adjuster member includes an outer second geared surface. The first geared surface is meshed with the second geared surface.

The binder assembly includes a first binder pivot pin connected to the first vertical adjuster member, a second binder pivot pin connected to the second vertical adjuster member, and a pair of binder struts connected between the first binder pivot pin and the second binder pivot pin. Each of the first binder pivot pin and the second binder pivot pin lies in a horizontal plane. Each of the binder struts includes a compensation slot for receiving an end portion of the first binder pivot pin. A spring is placed between the first binder pivot pin and the base-connected bracket for urging the first vertical adjuster member toward the second vertical adjuster member.

A tank-containing base assembly includes an annular tank and a reception well for receiving the first vertical adjuster member of the frame-connected bracket assembly. The annular tank includes locking clips adjacent to the reception well, and the first vertical adjuster member includes locking tabs which engage the locking clips when the first vertical adjuster member is inserted in the reception well.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least four preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is another object of the present invention to provide a new and improved martial arts exercise apparatus which may be easily and efficiently manufactured and marketed.

It is a further object of the present invention to provide a new and improved martial arts exercise apparatus which is of durable and reliable construction.

An even further object of the present invention is to provide a new and improved martial arts exercise apparatus which is susceptible of a low cost of manufacture with regard to both materials and labor, and which accordingly is then susceptible of low prices of sale to the consuming public, thereby making such martial arts exercise apparatus available to the buying public.

Still yet a further object of the present invention is to provide a new and improved martial arts exercise apparatus which permits a person to build strength and endurance for carrying out martial arts maneuvers that involve arms and hands, that involve legs and arms, that involve a rapid extension of one arm accompanied by a rapid contraction of the other arm, and that involve kicking with a leg and foot.

Still another object of the present invention is to provide a new and improved martial arts exercise apparatus that is adjustable for different persons' arms and hands.

Yet another object of the present invention is to provide a new and improved martial arts exercise apparatus that automatically adjusts when the angle between the person's chest and arms changes when alternating arm contraction and retraction take place.

Even another object of the present invention is to provide a new and improved martial arts exercise apparatus that can be used when a person extends and retracts one's arms and hands in a plane that forms an obtuse angle with respect to a horizontal surface.

Still a further object of the present invention is to provide a new and improved martial arts exercise apparatus which permits a person to build strength and endurance for carrying out martial arts maneuvers that involve kicking in a hands-free manner.

Yet another object of the present invention is to provide a new and improved martial arts exercise apparatus that permits a kicking target to be adjusted with respect to its height and its distance from the person exercising.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a first embodiment of the martial arts exercise apparatus of the invention in use for exercising a person's arms and hands.

FIG. 2 is an enlarged perspective view of the embodiment of the martial arts exercise apparatus shown in FIG. 1 removed from the person.

FIG. 7 is a partial side view of a third embodiment of the invention which permits a person to carry out martial arts maneuvers that involve extending and retracting a person's arms and hands in a plane that forms an obtuse angle with respect to a horizontal surface.

FIG. 8 is a cross-sectional view of the embodiment of the invention shown in FIG. 7 taken along line 8—8 thereof.

DESCRIPTION OF THE PREFERRED EMBODIMENT

Figure 3:
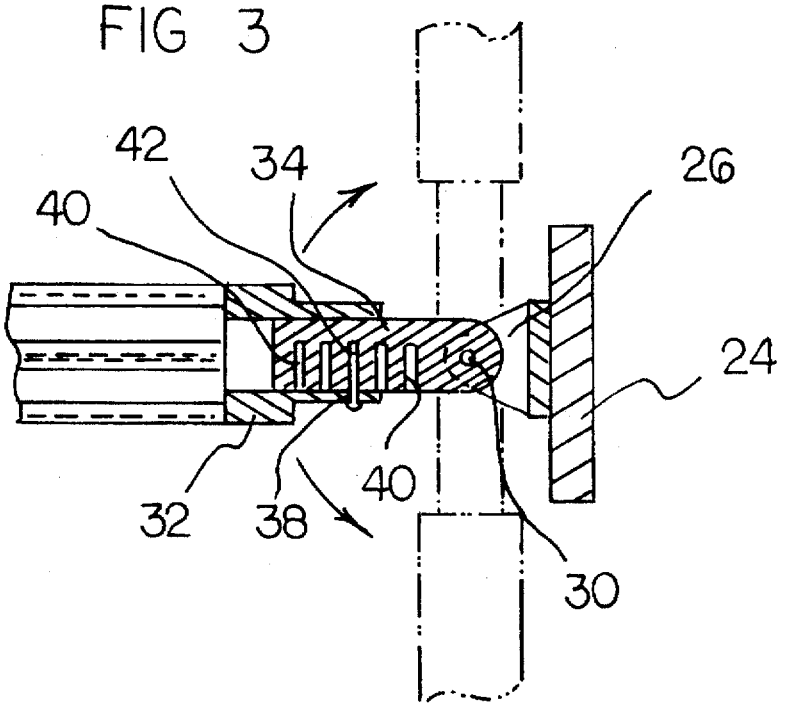
FIG. 3 is an enlarged cross-sectional view of the embodiment of the martial arts exercise apparatus of FIG. 2 taken along line 3—3 thereof.
Figure 4:
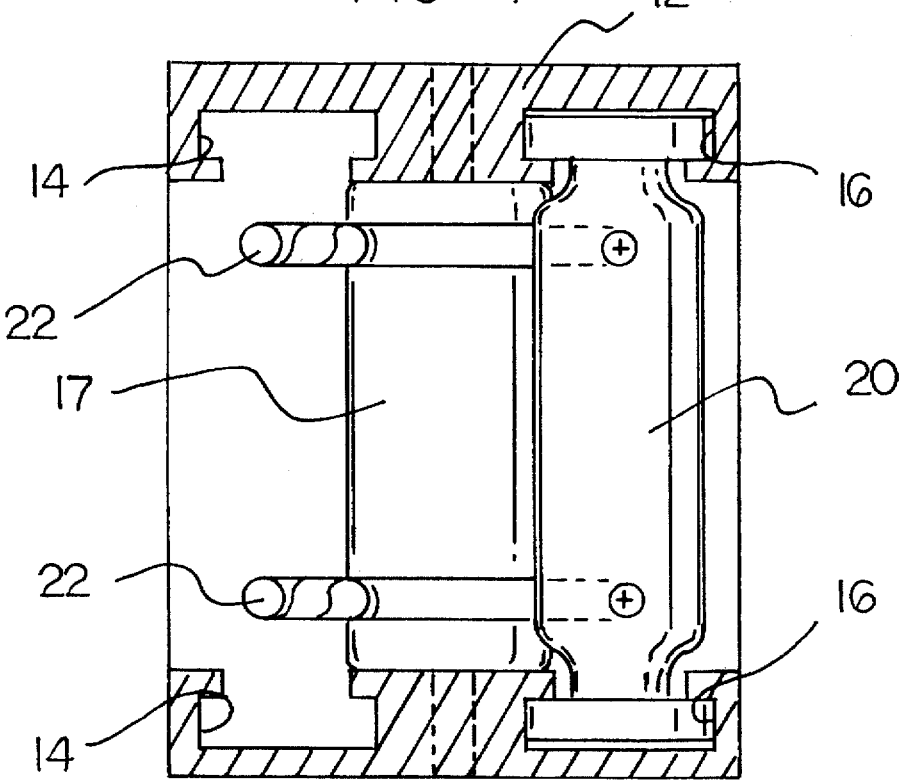
FIG. 4 is an enlarged cross-sectional view of the embodiment of the martial arts exercise apparatus of FIG. 2 taken along line 4—4 thereof.

With reference to the drawings, a new and improved martial arts exercise apparatus embodying the principles and concepts of the present invention will be described.

Turning to FIGS. 1–4, a first embodiment of the martial arts exercise apparatus of the invention is shown and is generally designated by reference numeral 10. The exercise apparatus 10 includes a frame 12 which includes a first pair of tracks 14 and a second pair of tracks 16. A first handle 18 is received in the first pair of tracks 14, a second handle 20 is received in the second pair of tracks 16. A motion-resistant assembly is connected to the first handle 18 and the second handle 20. A base member 24 is provided, and a frame-to-base pivot assembly is connected between the frame 12 and the base member 24.

The motion-resistant assembly includes a pulley 17 positioned between the first pair of tracks 14 and the second pair of tracks 16 at a first end 13 of the frame 12, and a pair of flexible lines 22 extended around a portion of the pulley 17 and connected between the first handle 18 and the second handle 20.

The frame-to-base pivot assembly includes a base-connected bracket 26 connected to the base member 24. A frame-connected bracket assembly is connected to the frame 12, and a pivot pin 30 is connected between the base-connected bracket 26 and the frame-connected bracket assembly. The pivot pin 30 lies in a vertical plane. With the pivot pin 30 in a vertical plane, when the frame 12 and the base member 24 move relative to each other, they move in a horizontal plane.

In using the first embodiment of the invention, a person 15 places the base member 24 of the exercise apparatus 10 on one's chest. The person's left hand grasps the first handle 18, and the person's fight hand grasps the second handle 20. The person alternates extending and retracting his arms. When this occurs, the relative angle of the base member 24 and the frame 12 changes in a horizontal plane as the frame 12 pivots around the vertically oriented pivot pin 30. Also, as the person's arms are alternately extended and retracted as the first handle 18 and the second handle 20 are grasped, the pair of flexible lines 22 reverse their respective directions as they move around the pulley 17. Also, as the person's arm are alternately extended and retracted, the first handle 18 and the second handle 20 alternately ride up and down the respective first pair of tracks 14 and the second pair of tracks 16.

The frame-connected bracket assembly includes a first bracket member 32 connected to the frame 12, a second bracket member 34 received by the first bracket member 32, and a bracket lock connected between the first bracket member 32 and the second bracket member 34. The first bracket member 32 includes a first pin channel 38. The second bracket member 34 includes a plurality of selectable second pin channels 40, and the bracket lock includes a locking pin 42 that is placed through the first pin channel 38 and one of the selected second pin channels 40 when the first pin channel 38 and the selected second pin channel 40 are placed in registration. To adjust the first bracket member 32 with respect to the second bracket member 34 longitudinally, the locking pin 42 is removed, and the first bracket member 32 is moved longitudinally with respect to the second bracket member 34. A selected second pin channel 40 is placed in registration with the first pin channel 38, and the locking pin 42 is inserted through the first pin channel 38 and the selected second pin channel 40.

Figure 5:
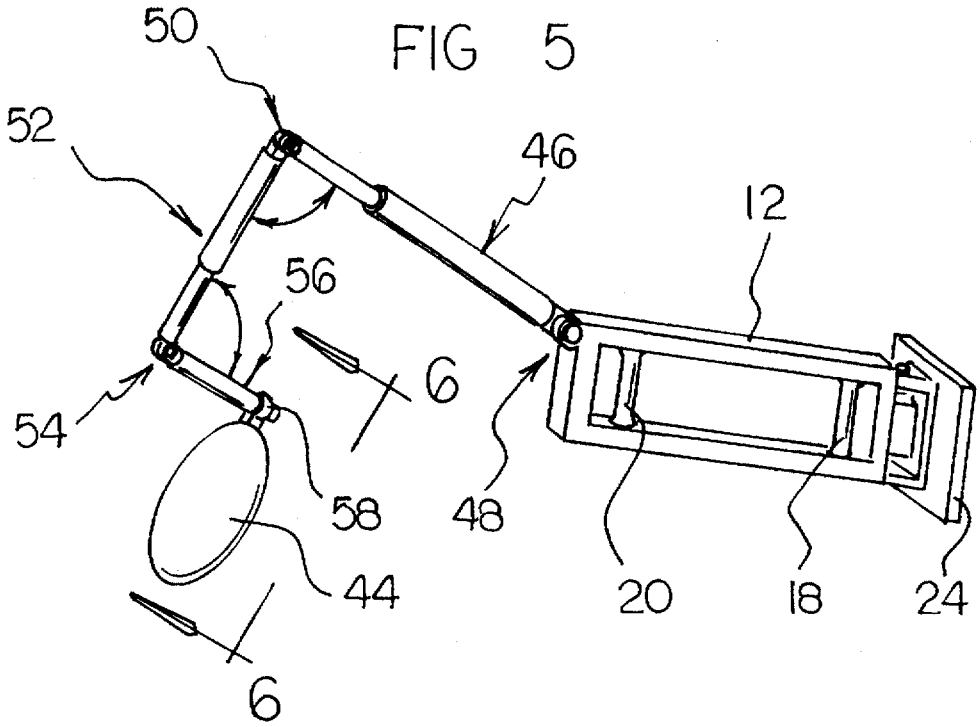
FIG. 5 is a perspective view of a second embodiment of the invention which employs an attachment for providing a kicking target.
Figure 6:
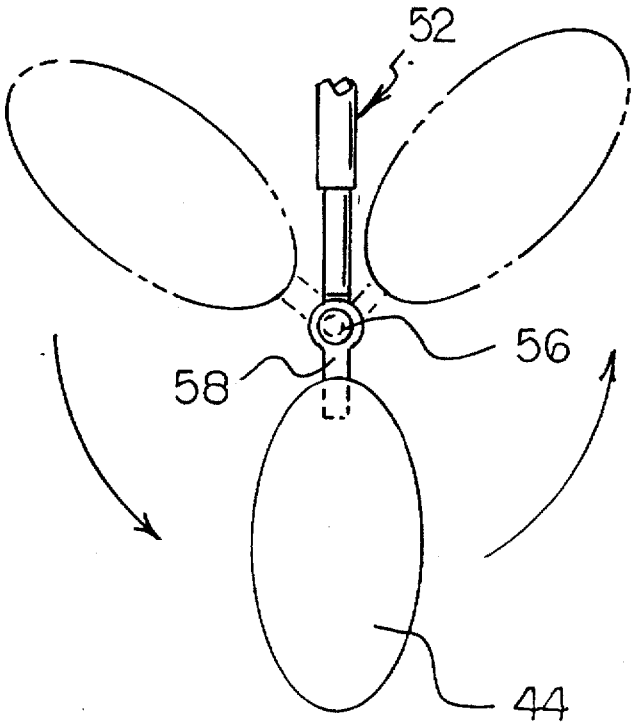
FIG. 6 is side view of the portion of the embodiment of the invention shown in FIG. 5 showing different orientations of the kicking target.

Turning to FIGS. 5 and 6, a second embodiment of the invention is shown. Reference numerals are shown that correspond to like reference numerals that designate like elements shown in the other figures. In addition, a kick target assembly is connected to the frame 12. The kick target assembly includes a kick target member 44 and a target adjustment assembly connected between the kick target member 44 and the frame 12. The target adjustment assembly includes a first orientation-adjustment lock 48 connected to the frame 12. A first extension assembly 46 is connected to the first orientation-adjustment lock 48. A second orientation-adjustment lock 50 is connected to the first extension assembly 46. A second extension assembly 52 is connected to the second orientation-adjustment lock 50. A third orientation-adjustment lock 54 is connected to the second extension assembly 52, and a third extension assembly 56 is connected to the third orientation-adjustment lock 54. A kick-target-support bracket 58 is connected to the third extension assembly 56. The kick target member 44 is connected to the kick-target-support bracket 58.

To use the embodiment of the invention shown in FIGS. 5 and 6, the respective first orientation-adjustment lock 48, second orientation-adjustment lock 50, third orientation-adjustment lock 54, and kick-target-support bracket 58 are adjusted and locked to control the respective angular orientations of the respective first extension assembly 46, second extension assembly 52, and third extension assembly 56. Moreover, the respective lengths of the first extension assembly 46 and the second extension assembly 52 can be adjusted longitudinally by adjusting respective telescopic members in the respective extension assemblies. The kick target member 44 can be oriented in a 360 degree orientation around the third extension assembly 56 as shown in FIG. 6.

The first orientation-adjustment lock 48, the second orientation-adjustment lock 50, and the third orientation-adjustment lock 54 can be conventional angular adjustment and lock assemblies. The first extension assembly 46 and the second extension assembly 52 can be conventional adjustable and lockable telescopic assemblies.

Turning to FIGS. 7 and 8, a third embodiment of the invention is shown. Reference numerals are shown that correspond to like reference numerals that designate like elements shown in the other figures. In addition, the frame-connected bracket assembly includes a vertical orientation adjustment assembly. The vertical orientation adjustment assembly includes a first vertical adjuster member 60 connected to the pivot pin 30, a second vertical adjuster member 62 connected to the frame 12, and a binder assembly connected between the first vertical adjuster member 60 and the second vertical adjuster member 62. The first vertical adjuster member 60 includes an outer first geared surface 61, and the second vertical adjuster member 62 includes an outer second geared surface 65. The first geared surface 61 is meshed with the second geared surface 65.

The binder assembly includes a first binder pivot pin 63 connected to the first vertical adjuster member 60, a second binder pivot pin 64 connected to the second vertical adjuster member 62, and a pair of binder struts 66 connected between the first binder pivot pin 63 and the second binder pivot pin 64. Each of the first binder pivot pin 63 and the second binder pivot pin 64 lies in a horizontal plane. Each of the binder struts 66 includes a compensation slot 68 for receiving an end portion of the first binder pivot pin 63. A spring 70 is placed between the first binder pivot pin 63 and the base-connected bracket 26 for urging the first vertical adjuster member 60 toward the second vertical adjuster member 62. More specifically, the spring 70 causes the first geared surface 61 of the first vertical adjuster member 60 to be urged into contact with the second geared surface 65 of the second vertical adjuster member 62. Each of the first binder pivot pin 63 and the second binder pivot pin 64 is oriented in a horizontal plane. As a result, when the first geared surface 61 and the second geared surface 65 move against each other, the frame 12 and the base member 24 move relative to each other in a vertical direction.

Figure 9:
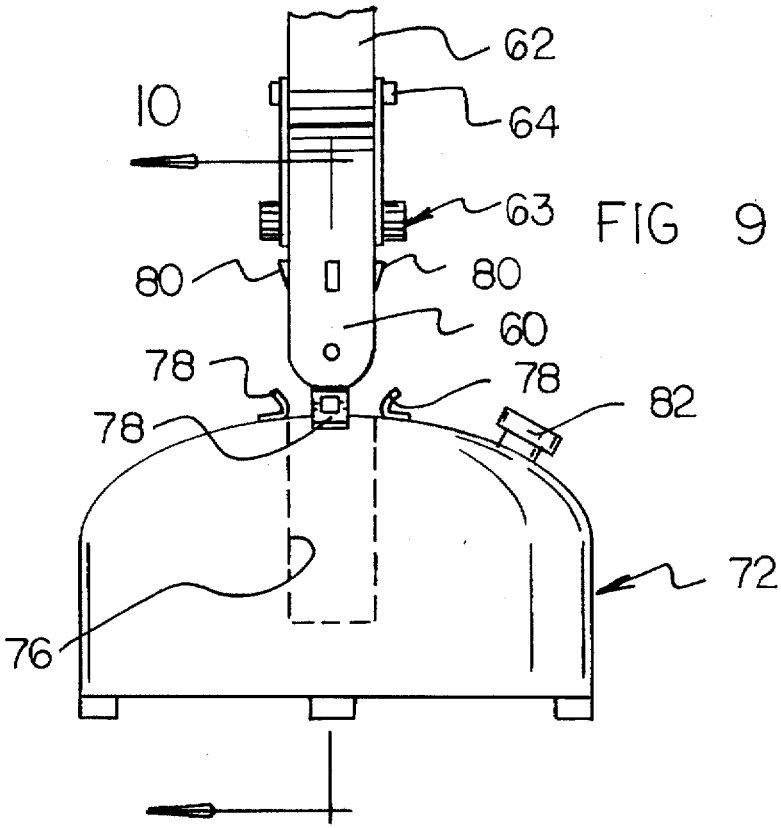
FIG. 9 is a side view of a fourth embodiment of the invention in which a tank-containing base is provided for enabling hands-free use of a kicking target.
Figure 10:
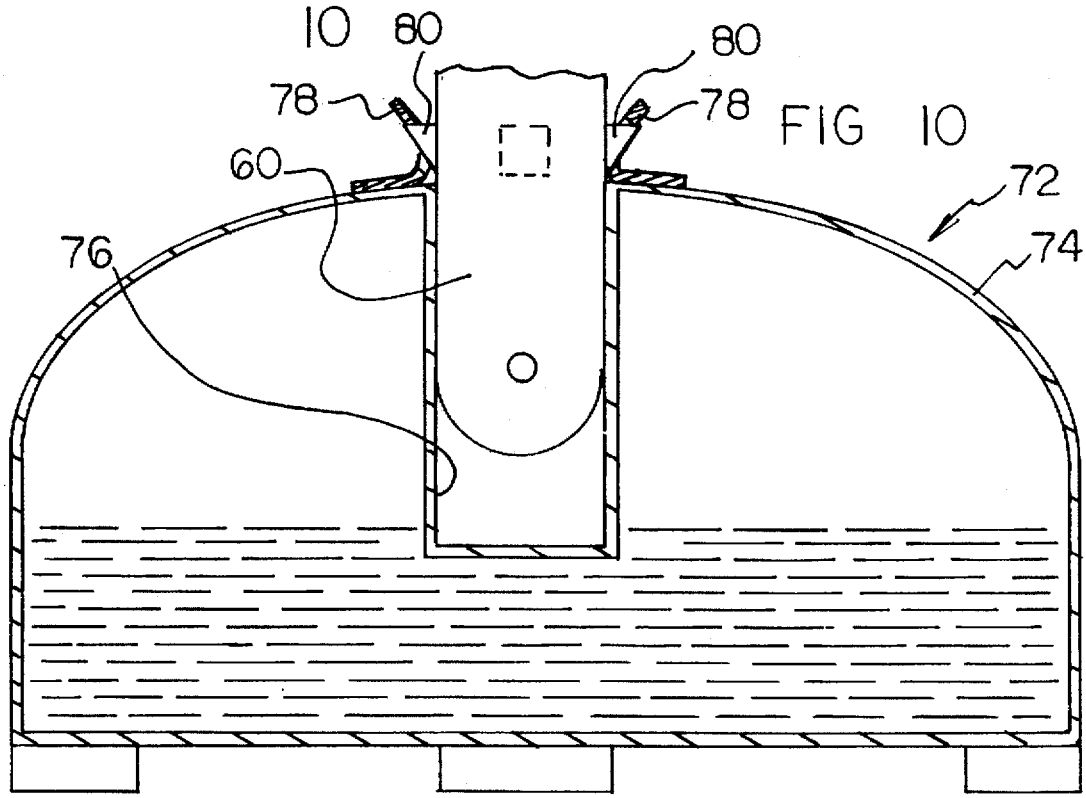
FIG. 10 is an enlarged cross-sectional view of the embodiment of the invention shown in FIG. 9 taken along line 10—10 thereof.

Turning to FIGS. 9 and 10, a fourth embodiment of the invention is shown. Reference numerals are shown that correspond to like reference numerals that designate like elements shown in the other figures. In addition, a tank-containing base assembly 72 includes an annular tank 74 and a reception well 76 for receiving the first vertical adjuster member 60 of the frame-connected bracket assembly. The annular tank 74 includes locking clips 78 adjacent to the reception well 76, and the first vertical adjuster member 60 includes locking tabs 80 which engage the locking clips 78 when the first vertical adjuster member 60 is inserted in the reception well 76.

To use the tank-containing base assembly 72, a cap 82 is removed from the annular tank 74, and a quantity of water is poured into the annular tank 74. Water is a relatively dense material which weighs one kilogram per liter. When water is added to the annular tank 74, the water weighs down the tank-containing base assembly 72. Moreover, water, is a liquid, fills the annular tank 74 from the bottom up. Therefore, the center of gravity of the tank-containing base assembly 72 is relatively low, which adds to the stability of the tank-containing base assembly 72.

To use the tank-containing base assembly 72, the base member 24 and the pivot pin 30 are removed from the first vertical adjuster member 60 of the frame-connected bracket assembly. Then, the first vertical adjuster member 60 is inserted into the reception well 76 of the tank-containing base assembly 72.

The components of the martial arts exercise apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved martial arts exercise apparatus that is low in cost, relatively simple in design and operation, and which may advantageously be used to permit a person to build strength and endurance for carrying out martial arts maneuvers that involve arms and hands, that involve legs and arms, that involve a rapid extension of one arm accompanied by a rapid contraction of the other arm, and that involve kicking with a leg and foot. With the invention, a martial arts exercise apparatus is provided that is adjustable for different persons' arms and hands. With the invention, a martial arts exercise apparatus is provided that automatically adjusts when the angle between the person's chest and arms changes when alternating arm contraction and retraction take place. With the invention, a martial arts exercise apparatus is provided which can be used when a person extends and retracts one's arms and hands in a plane that forms an obtuse angle with respect to a horizontal surface. With the invention, a martial arts exercise apparatus is provided which permits a person to build strength and endurance for carrying out martial arts maneuvers that involve kicking in a hands-free manner. With the invention, a martial arts exercise apparatus is provided which permits a kicking target to be adjusted with respect to its height and its distance from the person exercising.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

What is claimed as being new and desired to be protected by LETTERS PATENT of the United States is as follows:

1. An exercise apparatus, comprising:

a frame which includes a first pair of tracks and a second pair of tracks, a first handle received in said first pair of tracks, a second handle received in said second pair of tracks, a pulley positioned between said first pair of tracks and said second pair of tracks at a first end of said frame, and a flexible line extended around a portion of said pulley and connected between said first handle and said second handle, a base member, and a frame-to-base pivot assembly connected between said frame and said base member.

2. The apparatus of claim 1 wherein said frame-to-base pivot assembly includes:

a base-connected bracket connected to said base member, a frame-connected bracket assembly connected to said frame, and a pivot pin connected between said base-connected bracket and said frame-connected bracket assembly.

3. The apparatus of claim 2 wherein said pivot pin lies in a vertical plane.

4. The apparatus of claim 2 wherein said frame-connected bracket assembly includes:

a first bracket member connected to said frame, a second bracket member received by said first bracket member, and a bracket lock connected between said first bracket member and said second bracket member.

5. The apparatus of claim 4 wherein:

said first bracket member includes a first pin channel, said second bracket member includes a plurality of selectable second pin channels, and said bracket lock includes a locking pin that is placed through said first pin channel and one of said selected second pin channels when said first pin channel and the selected second pin channel are placed in registration.

6. The apparatus of claim 1, further including:

a kick target assembly connected to said frame.

7. The apparatus of claim 6 wherein said kick target assembly includes:

a kick target member, and a target adjustment assembly connected between said kick target member and said frame.

8. The apparatus of claim 7 wherein said target adjustment assembly includes:

a first orientation-adjustment lock connected to said frame, a first extension assembly connected to said first orientation-adjustment lock, a second orientation-adjustment lock connected to said first extension assembly, a second extension assembly connected to said second orientation-adjustment lock, a third orientation-adjustment lock connected to said second extension assembly, and a third extension assembly connected to said third orientation-adjustment lock, and a kick-target-support bracket connected to said third extension assembly, wherein said kick target member is connected to said kick-target-support bracket.

9. The apparatus of claim 1 wherein said frame-connected bracket assembly includes a vertical orientation adjustment assembly.

10. The apparatus of claim 9 wherein said vertical orientation adjustment assembly includes:

a first vertical adjuster member connected to said pivot pin, a second vertical adjuster member connected to said frame, and a binder assembly connected between said first vertical adjuster member and said second vertical adjuster member.

11. The apparatus of claim 10 wherein:

said first vertical adjuster member includes an outer first geared surface, and said second vertical adjuster member includes an outer second geared surface, wherein said first geared surface is meshed with said second geared surface.

12. The apparatus of claim 10 wherein said binder assembly includes:

a first binder pivot pin connected to said first vertical adjuster member, a second binder pivot pin connected to said second vertical adjuster member, and a pair of binder struts connected between said first binder pivot pin and said second binder pivot pin.

13. The apparatus of claim 12 wherein each of said first binder pivot pin and said second binder pivot pin lies in a horizontal plane.

14. The apparatus of claim 12 wherein each of said binder struts includes a compensation slot for receiving an end portion of said first binder pivot pin, and further including a spring placed between said first binder pivot pin and said base-connected bracket for urging said first vertical adjuster member toward said second vertical adjuster member.

* * * * *